United States Patent [19]

Brydges

[11] Patent Number: 4,897,958

[45] Date of Patent: Feb. 6, 1990

[54] WINDOW-BOX AND SUPPORT

[76] Inventor: Ronald Brydges, 6 Faye Cresent, St. Catharines Ontario, Canada, L2N 1N7

[21] Appl. No.: 261,722

[22] Filed: Oct. 24, 1988

[51] Int. Cl.[4] ..... A01G 9/02

[52] U.S. Cl. ..... 47/68; 248/208

[58] Field of Search ..... 47/66, 67, 68; 248/208, 248/225.1, 231.4, 231.9, 297.3, 298

[56] References Cited

U.S. PATENT DOCUMENTS

| | | | |
|---|---|---|---|
| 1,558,977 | 10/1925 | Gray | 248/208 |
| 1,755,453 | 4/1930 | Mullen | 248/48.1 |
| 1,809,216 | 6/1931 | Quandt | 248/208 |
| 2,717,139 | 9/1955 | Jewell | 248/208 |
| 2,880,952 | 4/1959 | Moore et al. | 248/208 |
| 2,945,358 | 7/1960 | MacLeod et al. | 248/208 |
| 3,946,522 | 3/1976 | Schifman | 47/68 |

*Primary Examiner*—Robert A. Hafer
*Assistant Examiner*—Lynda M. Cofsky
*Attorney, Agent, or Firm*—McConnell and Fox

[57] ABSTRACT

A window-box is formed from a plastic tray having a lip on its upper edge which hooks over a ridged connector strip mounted on a window-ledge. A pair of legs adjustably mounted on the bottom of the tray brace the box against the wall below the window-ledge.

9 Claims, 2 Drawing Sheets

WINDOW-BOX AND SUPPORT

FIELD OF THE INVENTION

This invention relates to window-boxes, particularly boxes intended to be supported from a shelf or window-ledge and contain plants in flower pots or seedling trays, the box being so designed, together with its support, that may be readily attached to either an internal or external window-ledge without damage to the frame of the window or the ledge.

DESCRIPTION OF THE PRIOR ART

Window-boxes have been proposed in the past formed of wood or metal. A typical example of a metallic window-box planter is shown in U.S. Pat. No. 3,800,470. It will be noticed, however, in that case, that the window-box is mounted directly on the wall of the house on the exterior with screws which obviously will damage the siding and would probably be most unsuitable for internal window-ledge.

Another typical structure for a window-box is shown in U.S. Pat. No. 2,223,074 and, once again, it will be seen that the box's support is by means of screws into the window-frame.

A further structure related to the present invention is shown in Canadian Patent No. 1,024,742. In this case, the box is supported by means of tubular shafts having hooks which hook over the window-sill and include adjustable legs to brace the box against an outside wall. As will be seen, the installation requires that the window be open so that the hooks can engage the inner side of the window-frame, while the legs bear against the outside wall. While this arrangement may be suitable in some cases, it obviously will not be useful where it is not desired to have the window open or in cases where the window does not operate in the manner of a double hung window, for example, in a casement window.

SUMMARY OF THE INVENTION

In accordance with the present invention, the window-box consists of a plastic tray with a lip formed to engage a ridged engagement strip attached to the window-ledge. The bottom of the tray is provided with longitudinal leg connector slides to adjustably receive legs formed to provide braces to support the box by bearing against the wall below the ledge.

A clearer understanding of my invention may be had from a consideration of the following drawings in which.

DESCRIPTION OF THE PREFERRED EMBODIMENT

Figure 1:
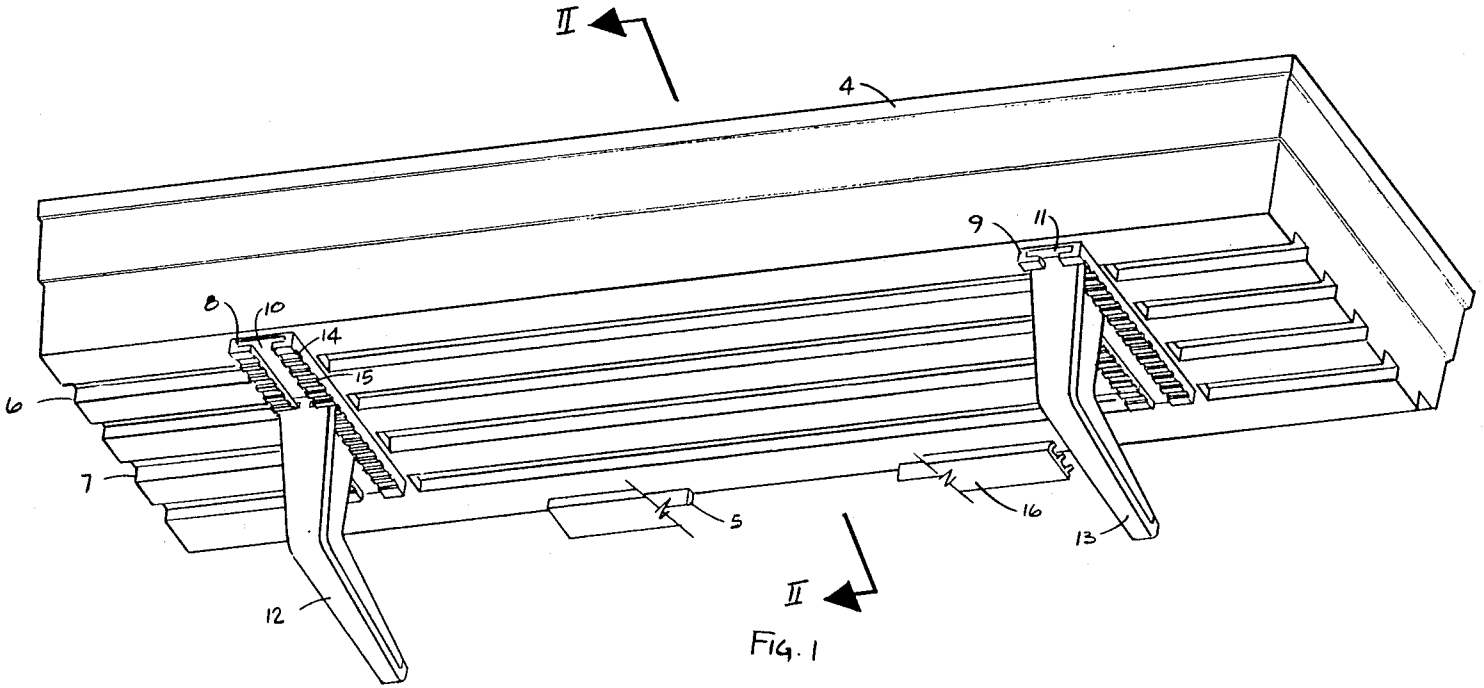
FIG. 1 is a perspective view of the assembled box.
Figure 3B:
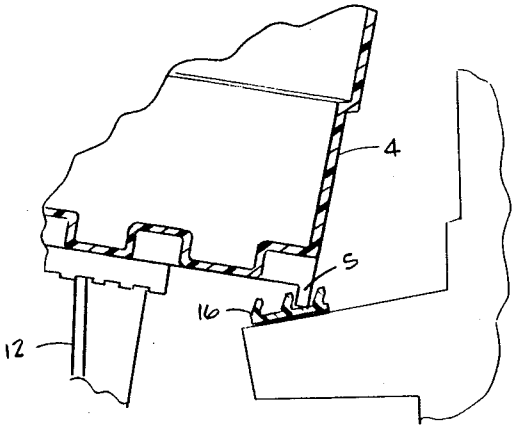
FIGS. 3A and 3B are details of portions of the assembly shown in cross-section.
Figure 2:
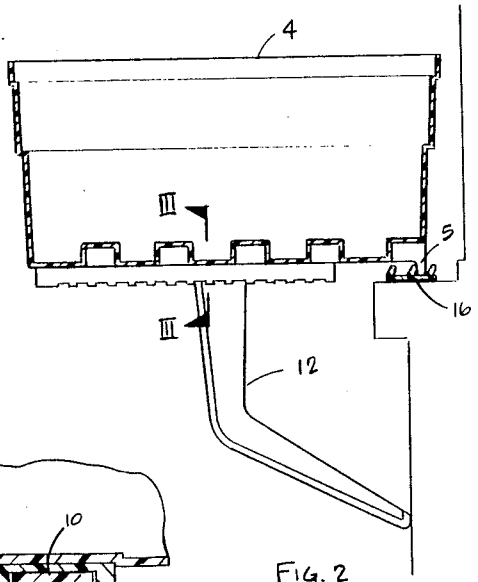
FIG. 2 is a sectional view through section line 2—2 of FIG. 1.

Considering first FIG. 1, the window-box comprises a plastic molded tray 4 having a lip 5 (shown more clearly in FIGS. 2 and 3B) and a corrugated lower surface formed by a series of channels, such as channels 6 and 7. At two locations the channels are interrupted by leg connector slide members 8 and 9 attached to the lower surface of the tray and including C-shaped slots designated 10 and 11 respectively. Legs 12 and 13 have an upper T-shaped form which co-operates with the C-shaped slots (shown in more detail in FIG. 3A).

Figure 3A:
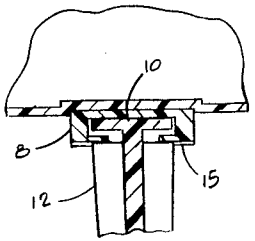

These slides 8 and 9 include on their lower surface a series of notches, such as notches 14 and 15 on slide 8, which co-operate with the legs 12 and 13 in a manner shown more clearly in FIG. 3A.

INSTALLATION AND OPERATION

A connector strip 16 (FIG. 2) is suitably located and mounted on the window-ledge or shelf. The legs 12 and 13 are slipped into the slot 10 and 11 of the slides 8 and 9. The lip 5 of the tray is hooked into the connector strip and held in a suitable substantially horizontal position. The legs 12 and 13 are then moved along the slides until their ends abut the wall or sash on which the ledge or shelf is mounted. The downward force of the tray on the legs 12 and 13 and their engagement with the wall cause them to rotate and their upper ends engage the notches in the slides which prevents them from moving along the slide after they have been suitably located.

It will seen that the actual plane of the lower surface of the tray can be adjusted by moving the legs so that it is substantially horizontal or tilted in one direction or the other as desired. It will also be noted that the forces on connector strip 16 are sheer forces and, therefore, attachment of the connector strip to the ledge or shelf need only be sufficient to overcome the sheer forces involved. Thus, while it is possible to mount the connector strip by means of screws, this is not necessary. Adhesives can be used which will not damage the frame or ledge and yet provide sufficient sheer strength. It will also be seen that the connector strip is the only portion of the assembly which is actually attached to the ledge, since legs 12 and 13 merely bear against the wall or sash and are not attached to the structure or house.

When it is desired to move the box or remove it, it is only necessary to lift it up and disengage lip 5 from the connector strip whereupon the only material still attached to the house is the connector strip. This arrangement is of particular advantage when it is desired to remove the box for seasonal reasons, for example, or when redecorating or refinishing the window.

As is seen in FIG. 1, the connector strip will have a length equal to a substantial portion of the length of the tray, but need not extend from end to end. Lip 5 will be of a similar dimension.

It will also be seen that the bottom of the tray has a series of corrugations, as previously noted, such as corrugations 6 and 7. These corrugations increase the flex strength of the lower surface and lend rigidity which permits the tray to be molded from a lesser cross-section of material, thus reducing the quantity of plastic required and also the weight. The corrugations also serve as a settling basin for excessive moisture. The upper edge of the tray 4 will normally be reinforced, preferrably by increasing the cross-section or by folding the upper edge back on itself to similarly increase the flex strength of this section of the box.

Evidently the dimensions of the tray may be selected as desired to fit the particular situation, but it will be evident that a number of standard lengths may be produced which will be suitable for most locations corresponding to the standard width of windows.

Because of the flexible mounting of the legs 12 and 13, they may be independently adjusted to take into account any variations in the wall with respect to the ledge in cases, for example, where the outer wall is made of stone or some other uneven substance thus ensuring that the tray is equally supported at each side. While specific cross-sections of the tray and legs and other parts have been shown, it will be evident that many variations may be made within the scope of my invention as defined in the claims.

Because the legs 12 and 13 are removable and the tray has a stepped cross-section, it is possible to nest a number of trays for storage or display.

While the upper end of the legs 12 and 13 are shown to engage notches, such as 14 and 15, it should be understood that such notches may not be essential. Depending upon the material used, the frictional engagement of the upper ends of the legs with the slides may be sufficient to positively locate the legs in the slide when installed.

I claim:

1. A window-box and mounting assembly for mounting on a window set in a wall comprising a rectangular plastic tray having an inner edge adjacent a window a lip formed on said inner edge to engaging a ridge on a ledge on a same side of the window as said tray and a pair of legs adjustably mounted on the bottom of said tray and engaging a wall below a ledge.

2. A window-box as claimed in claim 1 wherein said legs are adjustably mounted in slides transverse to the longitudinal axis of said tray.

3. A window-box as claimed in claim 2 wherein said tray has longitudinal corrugations in a lower surface.

4. A window-box as claimed in claim 2 wherein said slides are slots of C-shaped cross-section and said legs include T-shaped ends which are slidably engaged in said slides.

5. A window-box as claimed in claim 4 wherein said slides include a plurality of notches transverse to the longitudinal axes of the slides to releasably engage projections on said legs and prevent said legs from moving in said slides when so engaged.

6. A window-box and mounting assembly as claimed in claim 1 wherein said ridge on a ledge is provided by a connector strip mountable on a ledge.

7. A window-box and mounting assembly as claimed in claim 6 wherein said connector strip is adhesively mounted on a ledge.

8. A window-box and mounting assembly for mounting on the ledge of a window set in a wall comprising a rectangular plastic tray having substantially vertical sides, a first one of said sides for arrangement adjacent a window and a corrugated bottom, a lip formed along a substantial portion of a lower edge of said first side of said tray engaging a ridge of similar length on a ledge, a pair slidably mounted legs each having an upper and a lower end received in dots of a C-shaped cross-section formed in a lower surface of said tray transverse to the longitudinal axis of said tray, a means to locate the upper ends of said legs in said slots while the lower ends of said legs engage a wall below a window.

9. A window-box and mounting assembly as claimed in claim 8 wherein said means to locate said legs comprises a plurality of notches transverse to the longitudinal axes of the slots and co-operating projections on the upper ends of said legs which engage in said notches when the lower ends of said legs engage a wall.

* * * * *